US007256670B2

(12) United States Patent
Jahnes et al.

(10) Patent No.: US 7,256,670 B2
(45) Date of Patent: Aug. 14, 2007

(54) DIAPHRAGM ACTIVATED MICRO-ELECTROMECHANICAL SWITCH

(75) Inventors: Christopher V. Jahnes, Upper Saddle River, NJ (US); Jennifer L. Lund, Brookeville, MD (US); Katherine L. Saenger, Ossining, NY (US); Richard P. Volant, New Fairfield, CT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/523,310

(22) PCT Filed: Aug. 26, 2002

(86) PCT No.: PCT/US02/27115

§ 371 (c)(1),
(2), (4) Date: Jan. 27, 2005

(87) PCT Pub. No.: WO2004/019362

PCT Pub. Date: Mar. 4, 2004

(65) Prior Publication Data

US 2006/0017533 A1 Jan. 26, 2006

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 5,619,061 A * 4/1997 Goldsmith et al. ..... 257/528
5,627,396 A * 5/1997 James et al. ..... 257/415
6,100,477 A 8/2000 Randall et al.
6,483,395 B2 * 11/2002 Kasai et al. ..... 333/105
6,486,425 B2 * 11/2002 Seki ..... 200/181
6,621,387 B1 * 9/2003 Hopcroft ..... 333/262
6,750,742 B2 * 6/2004 Kang et al. ..... 333/262
6,750,745 B1 * 6/2004 Wei et al. ..... 335/78
7,126,447 B2 * 10/2006 Kawai ..... 335/78
2004/0056742 A1 * 3/2004 Dabbaj ..... 335/78

* cited by examiner

*Primary Examiner*—Elvin Enad
*Assistant Examiner*—Bernard Rojas
(74) *Attorney, Agent, or Firm*—H. Daniel Schnurmann

(57) ABSTRACT

A micro-electromechanical (MEM) RF switch provided with a deflectable membrane (60) activates a switch contact or plunger (40). The membrane incorporates interdigitated metal electrodes (70) which cause a stress gradient in the membrane when activated by way of a DC electric field. The stress gradient results in a predictable bending or displacement of the membrane (60), and is used to mechanically displace the switch contact (30). An RF gap area (25) located within the cavity (250) is totally segregated from the gaps (71) between the interdigitated metal electrodes (70). The membrane is electrostatically displaced in two opposing directions, thereby aiding to activate and deactivate the switch. The micro-electromechanical switch includes: a cavity (250); at least one conductive path (20) integral to a first surface bordering the cavity; a flexible membrane (60) parallel to the first surface bordering the cavity (250), the flexible membrane (60) having a plurality of actuating electrodes (70); and a plunger (40) attached to the flexible membrane (60) in a direction away from the actuating electrodes (70), the plunger (40) having a conductive surface that makes electric contact with the conductive paths, opening and closing the switch.

17 Claims, 15 Drawing Sheets

60
70
-
+
-
+
-
d

DIAPHRAGM ACTIVATED MICRO-ELECTROMECHANICAL SWITCH

TECHNICAL FIELD

The present invention is related to micro-electromechanical system (MEMS) switches, and more particularly to a MEMS switch that allows for controlled actuation with low voltages (less than 10V) while maintaining good switch characteristics such as isolation and low insertion loss.

BACKGROUND ART

Wireless communication devices are becoming increasingly popular, and as such, provide significant business opportunities to those with technologies that offer maximum performance and minimum costs. A successful wireless communication device provides clean, low noise signal transmission and reception at a reasonable cost and, in the case of portable devices, operates with low power consumption to maximize battery lifetime. A current industry focus is to monolithically integrate all the components needed for wireless communication onto one integrated circuit (IC) chip to further reduce the cost and size while enhancing performance.

One component of a wireless communication device that is not monolithically integrated on the IC is a switch. Switches are used for alternating between transmit and receive modes and are also used to switch filtering networks for channel discrimination. While solid state switches do exist and could possibly be integrated monolithically with other IC components, the moderate performance and relatively high cost of these switches has led to strong interest in micro electromechanical systems (MEMS) switches. MEMS switches are advantageously designed to operate with very low power consumption, offer equivalent if not superior performance, and can be monolithically integrated.

While MEMS switches have been under evaluation for several years, technical problems have delayed their immediate incorporation into wireless devices. One technical problem is the reliable actuation of the switch between the on and off states. This problem is exacerbated with the use of low switch actuation voltages, as is the case when these devices are integrated with advanced IC chips where available voltage signals are typically less than 10V. Prior art MEMS switch designs have been unable to provide reliable switching at low actuation voltages and power consumption while satisfying switch insertion loss and isolation specifications.

A typical design of a prior art MEMS switch is illustrated in FIGS. 1A-1B. MEMS switch 5 uses a pair of parallel electrodes 11 and 14 that are separated by a thin dielectric layer 12 and an air gap or cavity 13, bounded by dielectric standoffs 16. Electrode 14 is mounted on a membrane or movable beam which can be mechanically displaced. The other electrode 11 is bonded to substrate 10 and is not free to move. MEMS switch 5 has nominally two states, namely, open (as shown in FIG. 1A) or closed (as shown in FIG. 1B). In the open state, an air gap is present between electrodes 11 and 14 and the capacitance between these electrodes is low. In this state, an RF signal applied to electrode 14 would not be effectively coupled to electrode 11. MEMS switch 5 is closed by applying a DC electrostatic potential between the two electrodes 11 and 14, which displaces the movable electrode 14 to reduce the gap distance or make intimate contact with the dielectric layer 12 covering opposing electrode 11, as shown in FIG. 1B. Dielectric layer 12 prevents shorting the DC electrostatic potential between electrodes 11 and 14 and also defines the capacitance of the switch in the closed state. When electrode 14 contacts dielectric layer 12, the capacitance increases, and an RF signal on electrode 14 effectively couples to electrode 11. To deactivate the switch, the electrostatic potential is removed allowing the membrane (or beam) to mechanically return to its original position and restore gap 13 between the parallel electrodes. However, MEMS switch devices, by definition, are small, and effects such as dielectric charging and stiction often interfere with the reliable activation and deactivation of the MEMS switch. As noted above, for applications where MEMS switches are used in portable communication devices, the supply voltages allowed cannot reliably drive most prior art MEMS switches. For designs that insure reliable switch deactivation, unacceptably high voltages are required. Furthermore, these voltages must be increased over the lifetime of the switch due to a deterioration of the dielectric overcoat layer 12. For reliable switch activation, the membrane or movable beam is fabricated to have a low stiffness, which decreases the required actuation voltage and subsequent damage to dielectric overcoat 12. However, due to stiction, a low stiffness also increases the probability that the beam or membrane will not be deactivated when the activation voltage is removed, leaving the switch in the closed position. Moreover, MEMS switches used in portable communication devices also require low on insertion loss and high off-state isolation, which, in part, dictates the gap requirements between stationary electrode 11 and movable electrode 14.

To date, there is no known manufactured MEMS switch device that satisfies the reliability, low drive voltage, low power consumption, and signal attenuation requirements for portable communication device applications.

DISCLOSURE OF THE INVENTION

Accordingly, it is an object of the present application to provide a MEMS switch having electrodes energized by an applied DC voltage causing a moveable beam or membrane to open and close a circuit.

It is another object to provide a MEMS switch that decouples the actuator gap area from the RF signal gap area.

It is yet another object to provide a MEMS switch that has the combined advantages of a large gap in the "off" position (for high isolation) and a small (or nonexistent) gap in the "on" position (for low insertion loss).

It is further object of the invention to fabricate a MEMS switch that reliably provides a low loss on-state and high isolation off-state.

It is still a further object to provide a MEMS switch having electrodes above and below the beam or membrane to overcome problems caused by stiction.

SUMMARY OF THE INVENTION

The inventive design disclosed herein is a MEMS RF switch that uses a deflectable membrane to activate a switch contact. The membrane incorporates interdigitated metal electrodes which cause a stress gradient in the membrane when actuated with a DC electric field. The stress gradient results in a predictable bending or displacement of the membrane and is used to mechanically displace the switch contact. One of the unique benefits of this design over prior art switches is the decoupling of the actuator gap and the RF gap, which is not the case for the example shown in FIG. 1, where they are the same. In this inventive design, the RF gap area is totally segregated from the actuator electrode gap area. In addition to this unique attribute, the beam can be electrostatically displaced in two directions thereby aiding activation and deactivation of the switch.

In one aspect of the invention, there is provided a micro-electromechanical system (MEMS) switch that includes: a cavity; at least one conductive path integral to a first surface bordering the cavity; a flexible membrane parallel to the first surface bordering the cavity, the flexible membrane having a plurality of actuating electrodes; and a plunger attached to the flexible membrane in a direction away from the actuating electrodes, the plunger having at least one conductive surface to make electrical contact with the at least one conductive path.

In another aspect of the invention, there is provided a micro-electromechanical system (MEMS) switch that includes: a) a substrate comprising a conductive metal inlaid surface onto which a cavity is formed; b) on the cavity, a first sacrificial layer followed by a first conductive layer and by a second conductive or dielectric layer, the two conductive layers being patterned into the form of an inverted 'T'; c) a second sacrificial layer positioned in the cavity and planarized to the top surface of the cavity; d) a patterned metal layer on top of the planarized surface, a dielectric layer and patterned via holes to expose said patterned metal (on top of the planarized surface); e) a conductive surface filling the via holes and providing a finite thickness above the filled via holes, the conductive surface being patterned into the shape of actuating fingers, the combination of a) through e) forming a flexible membrane; and f) via holes etched through the flexible membrane and simultaneously providing access slots etched outside of the membrane, wherein air replaces the first and second sacrificial layers.

The MEMS switch of the invention can be advantageously configured as a single-pole-single-throw (SPST) or as a single-pole-multi-throw (SPMT) switch by parallel connection of the signal input of N number of switches for N number of throws.

BRIEF DESCRIPTION OF DRAWINGS

These and other objects, aspects and advantages of the invention as well as embodiments thereof will be better understood and will become more apparent from the following description when taken in conjunction with the accompanying drawings, in which.

BEST MODE FOR CARRYING OUT THE INVENTION

Figure 1A:
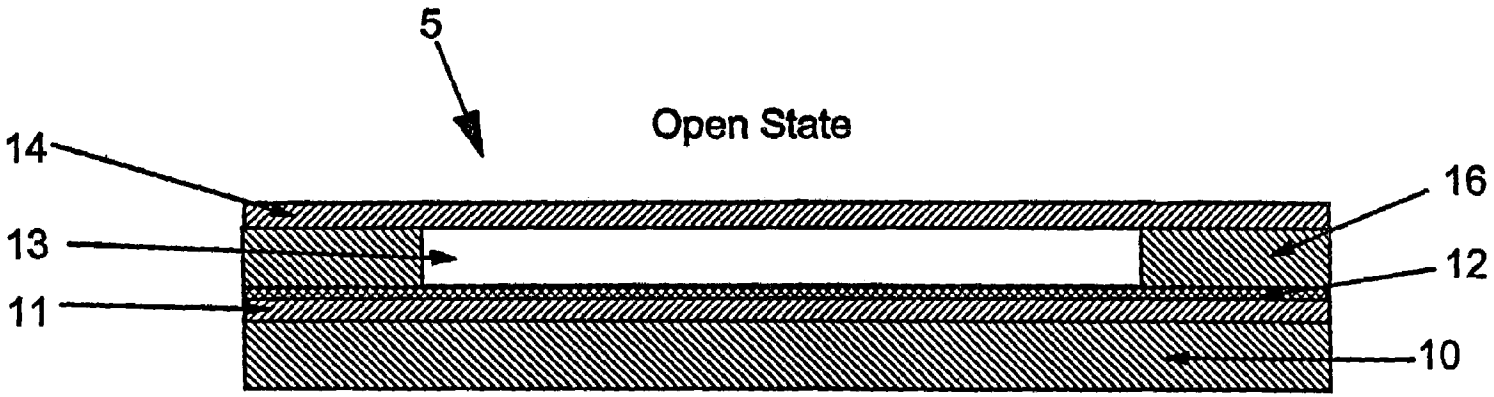
Figure 1A (PRIOR ART)
FIGS. 1A-1B are schematic diagrams of a prior art MEMS switch in the open and closed states.
Figure 1B:
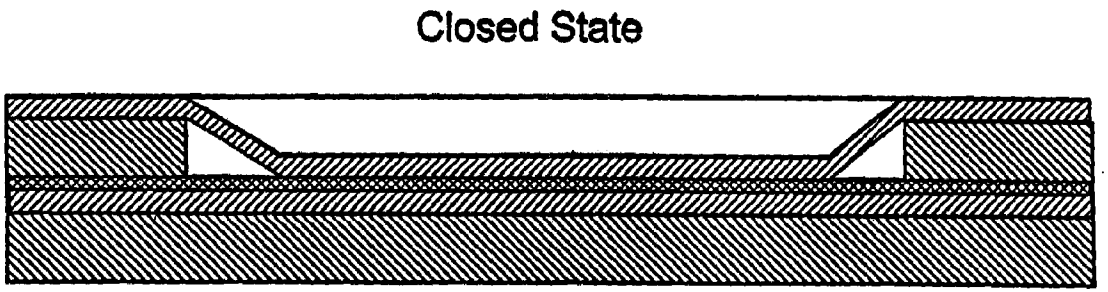
Figure 1B (PRIOR ART)
Figure 2B:
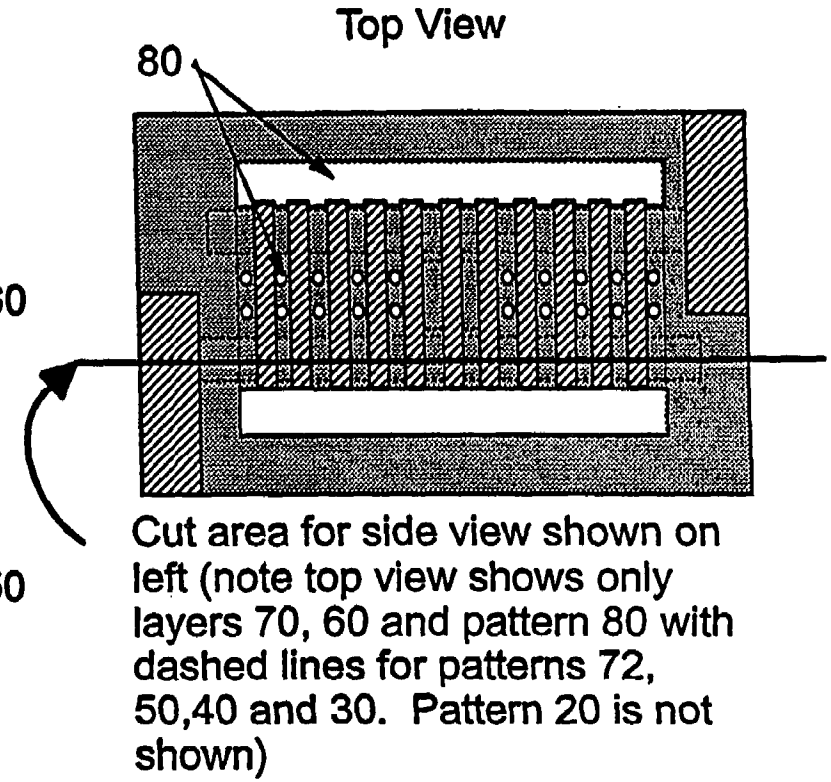
FIGS. 2A-2B are, respectively, a side view and a top-down view of the diaphragm activated MEMS switch, in accordance with the present invention.
Figure 2A:
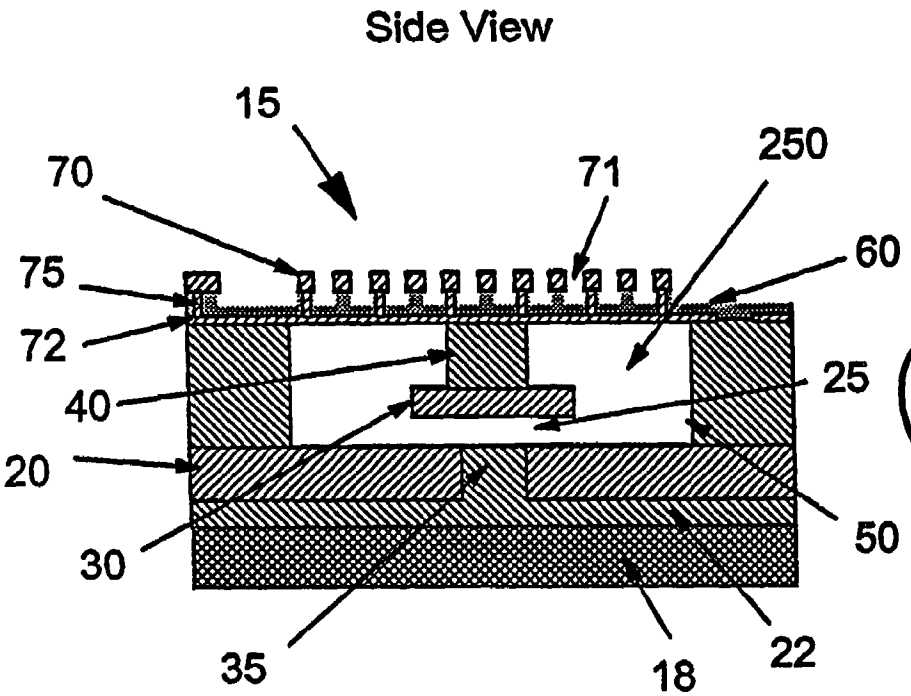

To fully illustrate the unique design of the inventive switch, a detailed description of the MEMS switch will now be described hereinafter with reference to FIGS. 2A-2B.

Device 15 is fabricated on a substrate 18 onto which a dielectric 22 is deposited with inlaid metal traces 20. This forms a surface with planar conductive electrodes separated by a dielectric region 35. Dielectric space 35 is bridged by metal contact electrode 30 when the dielectric actuator membrane 60 deflects downward and causes contact electrode 30 to touch or come in close proximity to metal traces 20. The contact formed allows an RF signal to propagate between the two metal electrodes 20 through metal contact electrode 30. Metal contact electrode 30 is within cavity 250 and physically attached to dielectric post (or plunger) 40, which in turn is physically attached to the membrane 60. Cavity 250 is bounded on the sides by dielectric standoffs 50. Also shown in FIG. 2B are access holes and slots 80 formed in dielectric layer 60 which provide a means for removing a sacrificial layer from cavity 250 and gap area 25 during device fabrication.

Top actuating electrodes 70, electrode gaps 71, conductive vias 75, and metal inlays 72 will be described further below.

Figure 3A:
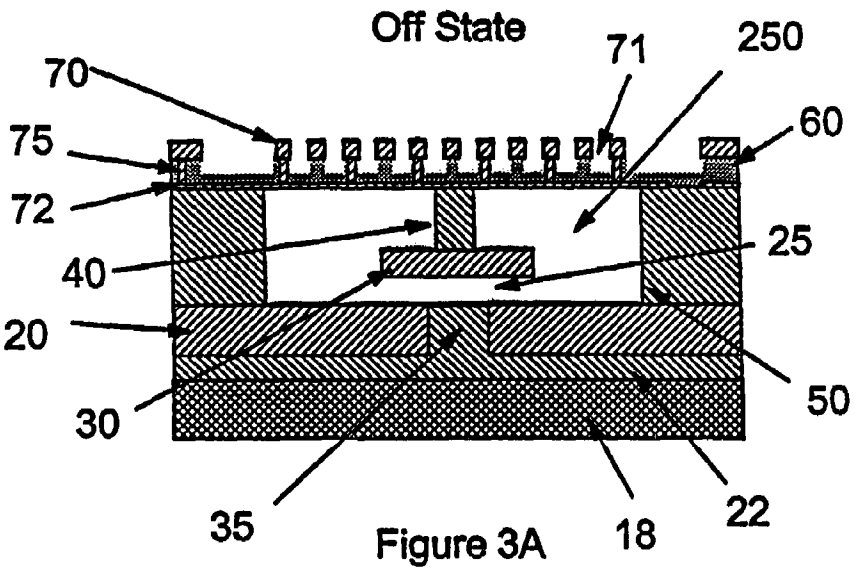
FIGS. 3A-3B are another cross-section diagram of the MEMS switch, according to the invention, showing the electrostatic attraction between metal actuators resulting in a bending curvature of the membrane.
Figure 3B:
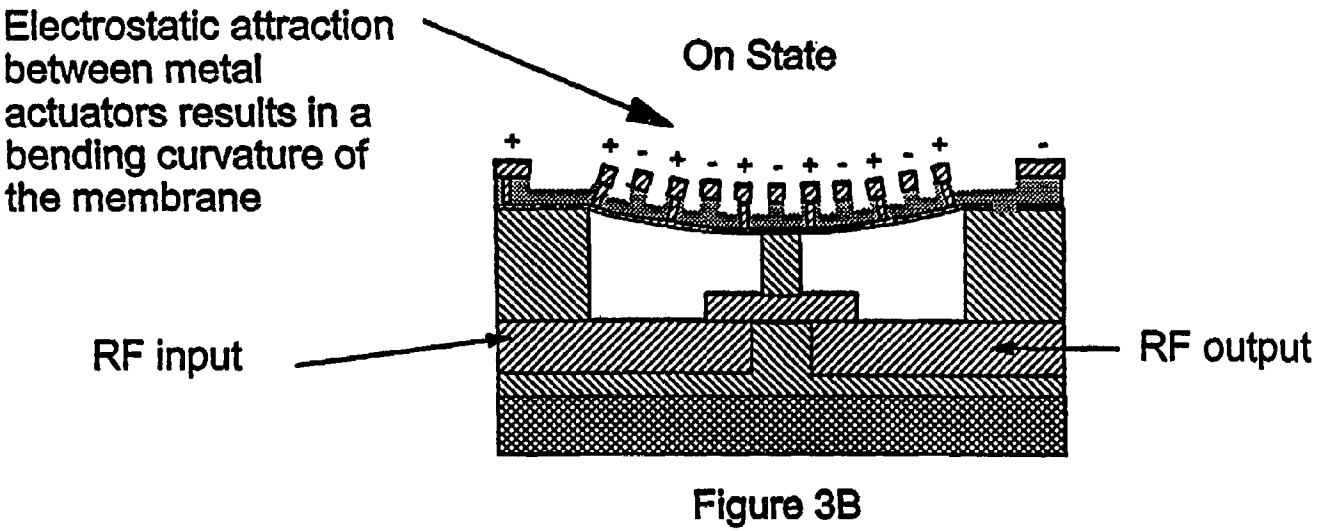

The operation of this new MEMS switch design is illustrated in FIGS. 3A-3B, which show the two switch states of the device. The switch is activated or closed by applying opposite polarity DC voltages (referenced to an arbitrary ground) to alternating actuation electrodes as indicated by way of 'plus' and 'minus' symbols, as shown in FIG. 3B. The electrostatic fields between the actuation electrodes causes the electrodes to become physically attracted to all surrounding electrodes within close proximity. This attraction generates a stress gradient in membrane 60, causing it to deflect downward, thereby pushing post 40 and contact electrode 30 until the bottom of contact electrode 30 physically touches the top of signal electrodes 20. The unique benefit of this design is the decoupling of gap 71, between the actuating electrodes 70 and gap 25, between the contact electrode 30 and signal switch contacts 20, all providing a switch wherein a low actuation voltage reliably displaces a contact electrode over a relatively large gap. The magnitude of the vertical displacement of the contact electrode 30 which dictates the RF signal attenuation in the "on" and "off" states is determined by the geometric design of the actuating electrodes and the membrane. Several additional benefits of this design are apparent. The mechanical restoring force required to reliably deactivate the switch is somewhat decoupled from the actuation voltage requirements.

Figures 4A, 4B, 4C:
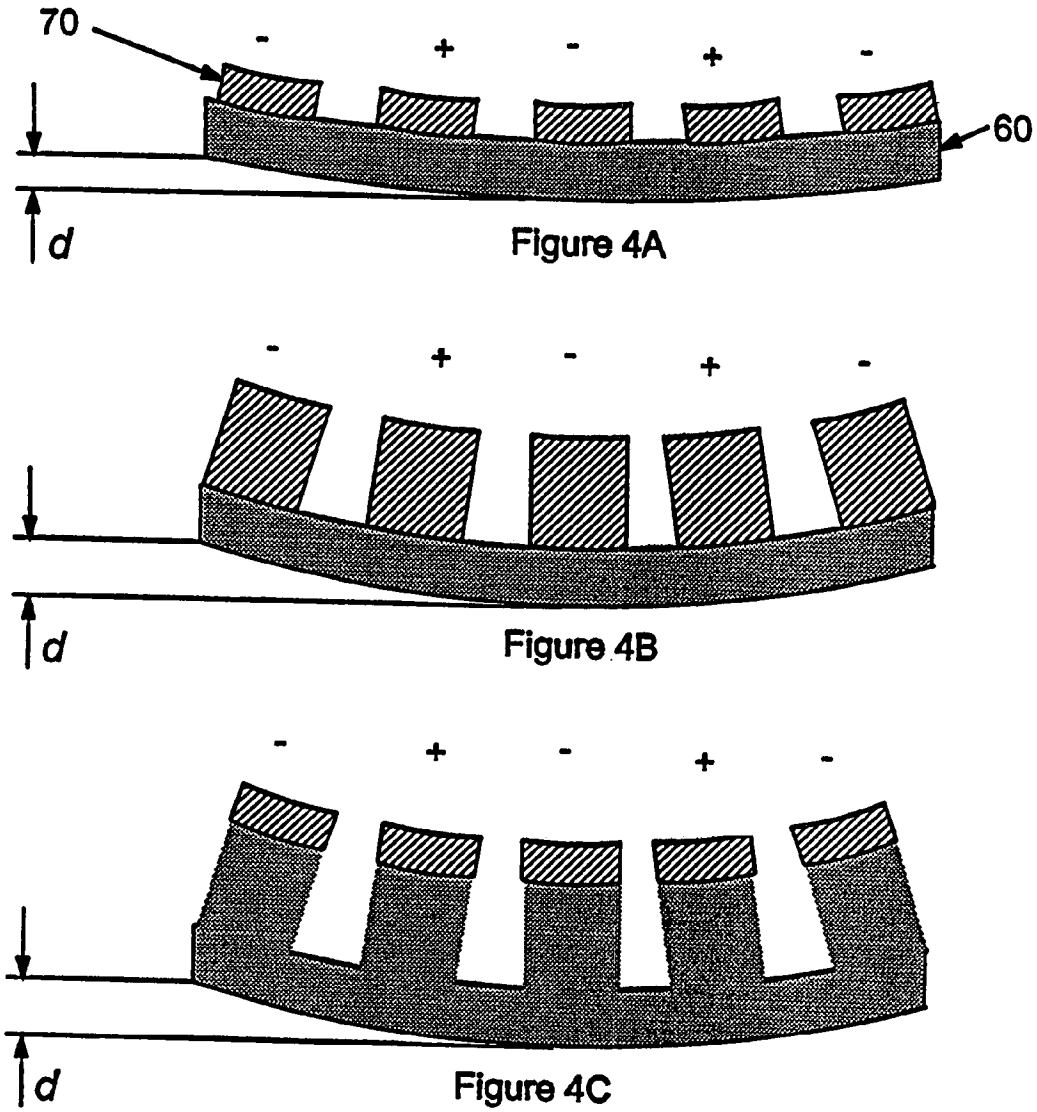
FIGS. 4A-4C are side views of membrane/electrode geometries that may be used with the switches of FIGS. 2-3 (for switches in the "on" state)

FIGS. 4A-4C show side views of two additional designs of actuation electrodes. For clarity, only a small portion of the membrane is shown and only details of electrodes 70 and dielectric 60 are included. The electrodes 70 act as levers, and when made taller, they induce more curvature which causes a greater vertical displacement d. Additional electrode overlap area may be introduced by increasing the metal thickness of the actuating electrodes 70, as shown in FIG. 4B. This decreases the required voltage to achieve an equivalent electrostatic force. The electrodes could also be made taller without additional electrode overlap, as shown in FIG. 4C. Greater vertical displacement is also achieved by increasing the length of the membrane and number of actuating electrodes. Another benefit of this unique actuation method is that the deactivation of the switch can be assisted by applying a positive voltage to all the actuating electrodes. In the present configuration, all the actuating electrodes tend to repel and cause an inverse curvature of the membrane thereby removing the contact between the bottom of contact electrode 30 and signal electrodes 20.

Figure 5:
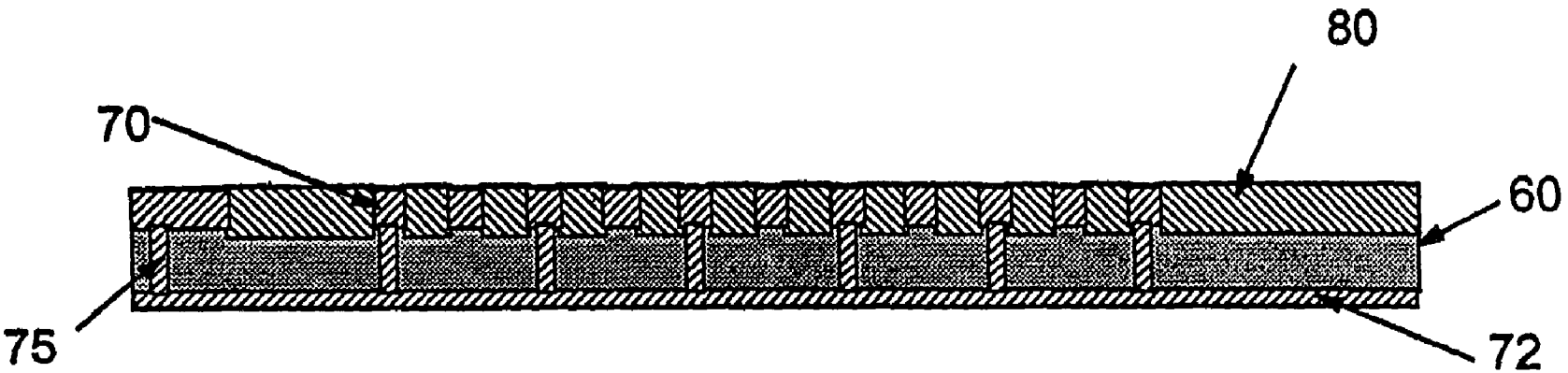
FIG. 5 shows an alternative membrane/electrode assembly for the MEMS switch of FIGS. 2-3 (for a switch in the "off" state), wherein piezoelectric elements are used in between the actuating electrodes instead of an air gap.

FIG. 5 shows an alternative membrane/electrode assembly for the MEMS switch of FIGS. 2-3 (for a switch in the "off state"), wherein piezoelectric elements are interposed between the actuating electrodes 70 instead of an air gap 71. The piezoelectric material contracts under the influence of an electric field, causing a stress gradient to bend the membrane, as shown in FIG. 3B. Piezoelectric material 80 expands in one crystalline axis direction under the influence of an electric field, causing a stress gradient between piezoelectric layer 80 and dielectric membrane 60. The stress gradient between piezoelectric material 80 and dielectric 60 generates a bowed membrane, similar to that shown in FIG. 3B. In this design, conductive via contacts 75 connect inlaid wire trace 72 and interdigitated fingers 70, as detailed in FIGS. 2 and 3. Depending on the piezoelectric material employed and its crystalline orientation, applying a voltage difference between the actuating fingers creates a concave or convex curvature.

Preferred materials for the piezoelectric elements are: $BaTiO_3$, $Pb(ZrxTil\text{-}x)O_3$ with dopants of La, Fe or Sr and polyvinylidene fluoride (PVDF) also known as Kynar™ piezo film (Registered Trademark of Pennwalt, Inc.).

Figure 6A:
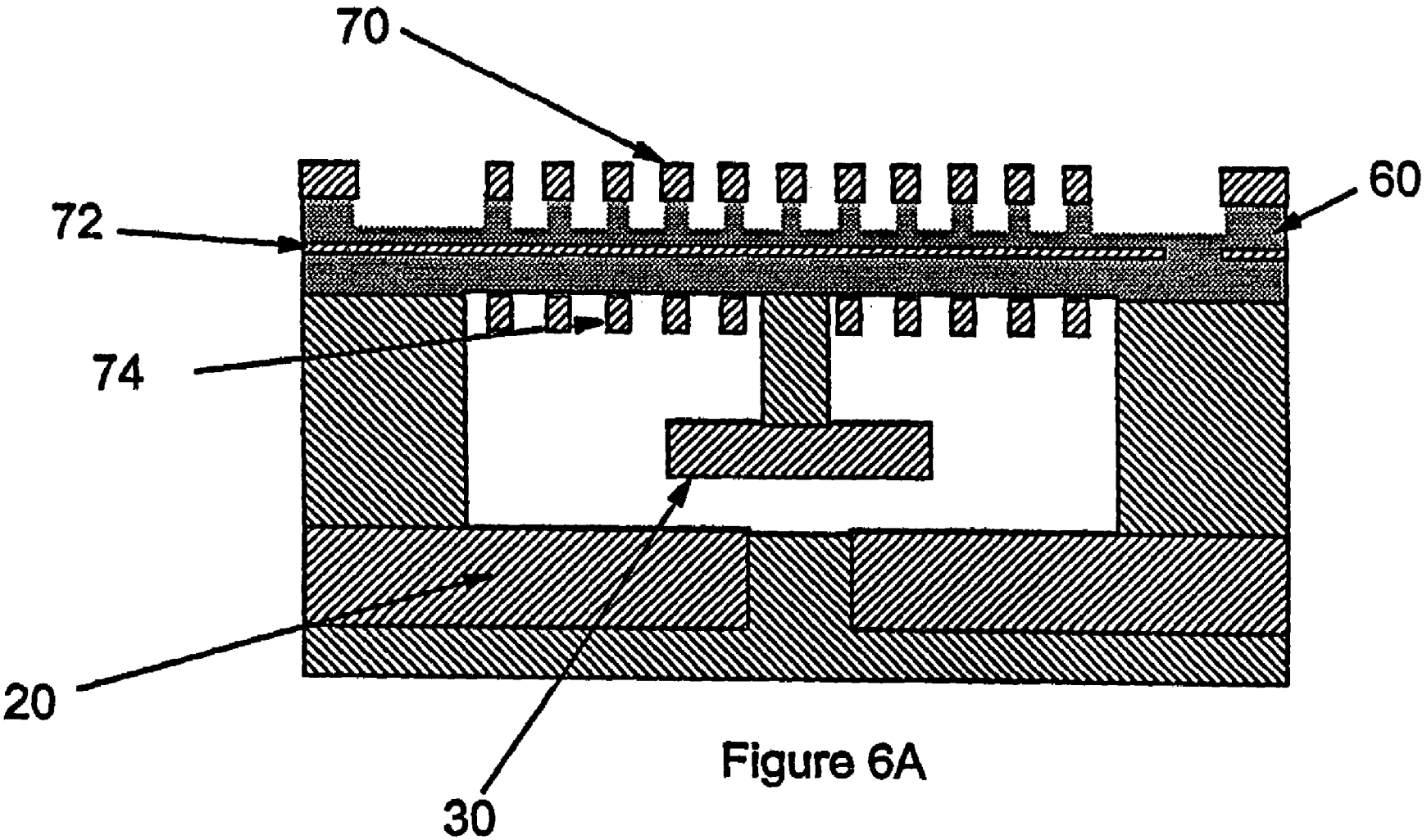
FIGS. 6A-6B illustrate still additional preferred embodiments showing interdigitated actuation electrodes both above and below the membrane (FIG. 6A) and an alternate "single contact" MEMS switch (FIG. 6B)

In still another preferred embodiment, an additional set of interdigitated actuating electrodes can be fabricated below the membrane as shown in FIG. 6A with the metal inlays 72 embedded in dielectric 60 and metal filled vias, not shown, connecting metal inlays 72 to fingers 70 or 74. In this design, the lower interdigitated actuating electrodes 74 are advantageously used for two functions. One function is to assist in the electrostatic "on" activation wherein all the lower electrode fingers 74 are pulsed with a positive voltage, while simultaneously applying alternating positive and negative potentials to the upper fingers 70. This provides an additional electrostatic force to displace the switch contact 30 such that it contacts or comes in close proximity to metal trace 20. The second function for the lower interdigitated electrodes is forcing the deactivation (conversion to the "off" state) of the switch. To deactivate the switch, alternating positive and negative potentials are applied to lower electrode fingers 74 while simultaneously pulsing all upper electrodes 70 with a positive voltage. The lower interdigitated electrodes thus aid in both the activation and deactivation of the switch.

Figure 6B:
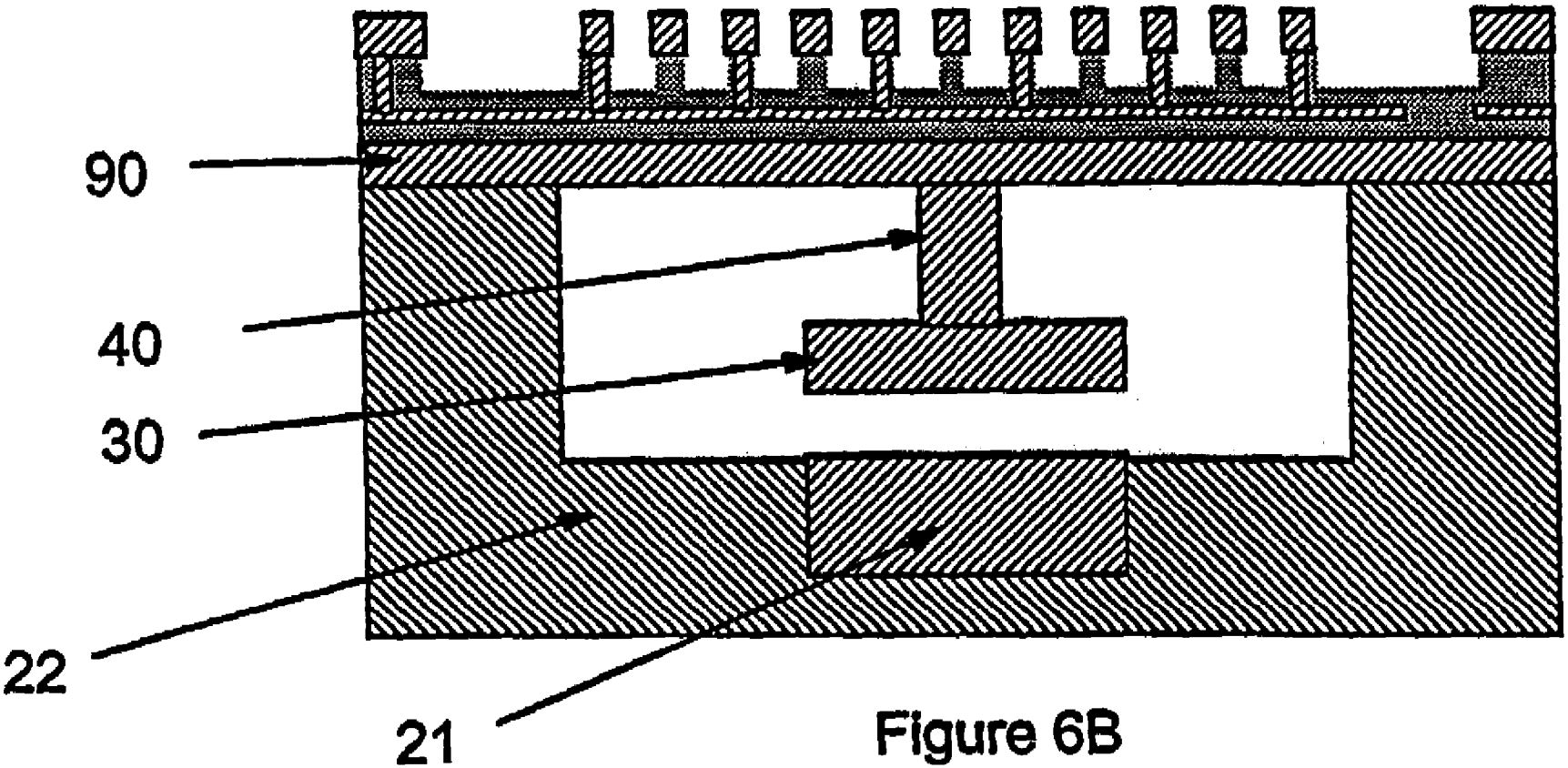

In yet another preferred embodiment, the switch is designed with only one mechanical RF signal contact, as shown in FIG. 6B. In this design, the RF signal path is directed through metal conductive layer 90, plunger element 40 and contact element 30. When the switch is activated, element 30 contacts or comes in close proximity to single metal trace 21 to close the switch. The benefit of this design is a reduction in contact resistance as compared to the one illustrated in FIG. 2, wherein element 30 bridges signal metal trace 20 and the two contact resistances are added in series.

Figure 7:
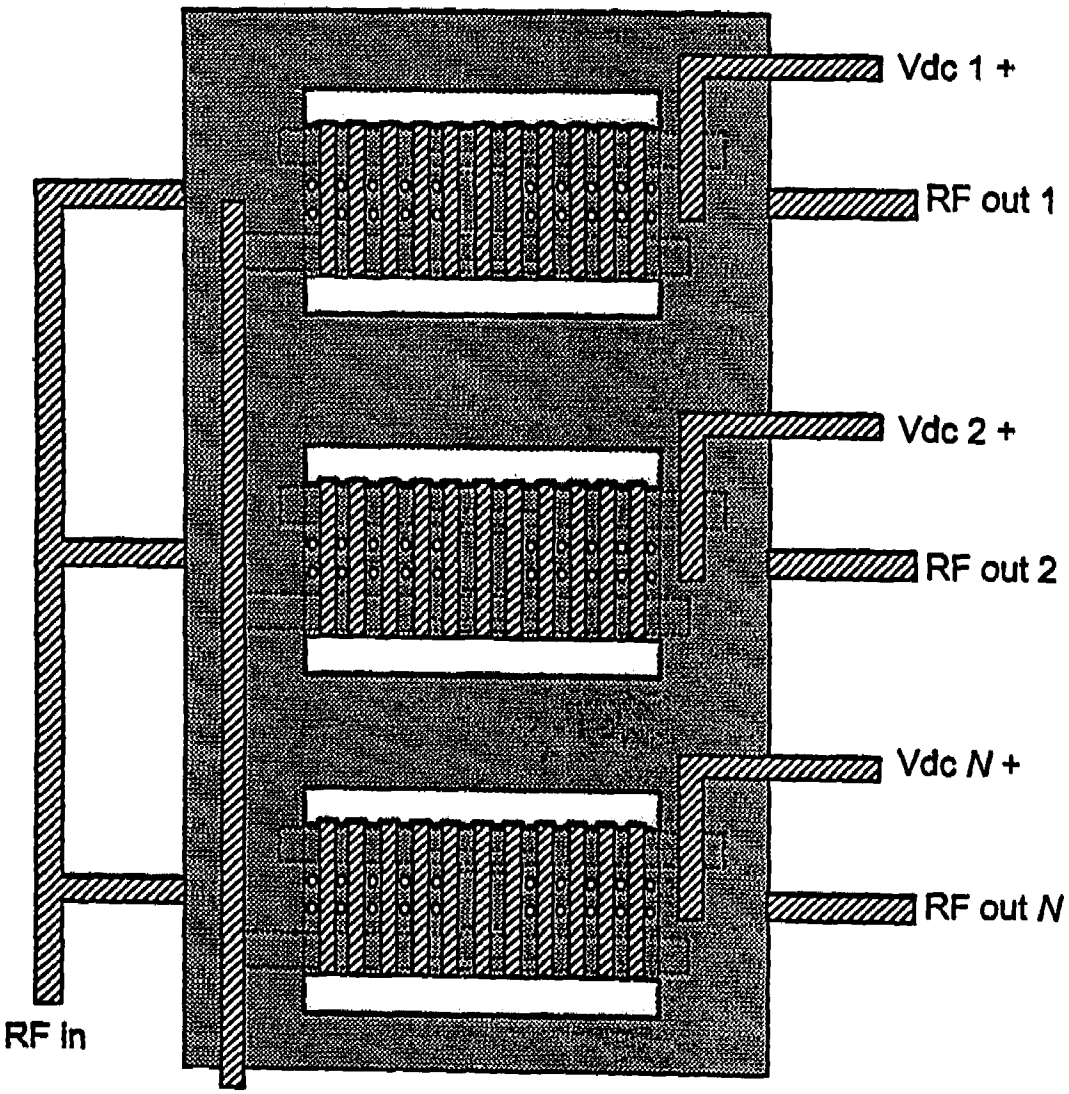
FIG. 7 depicts the MEMS switch in a single-pole-multi-throw. configuration.

The switch described may be configured as a single-pole-multi-throw (SPMT) switch by parallel connection of the signal input of N number of switches for N number of throws. This is shown in FIG. 7 using the single-throw switch depicted in FIG. 2 with the membrane/electrode geometry. A common RF input is applied to three MEMS switch devices with isolated RF outputs. To pass the RF input signal to any one of the RF outputs, the respective Vdc+ signal is applied to "activate" the switch. The switch described and shown may be configured as a resistive switch, as illustrated in FIGS. 2 and 3, or as a capacitively coupled switch by adding a thin dielectric layer over the signal electrodes 20 and/or bridge contact 30.

Figure 8A:
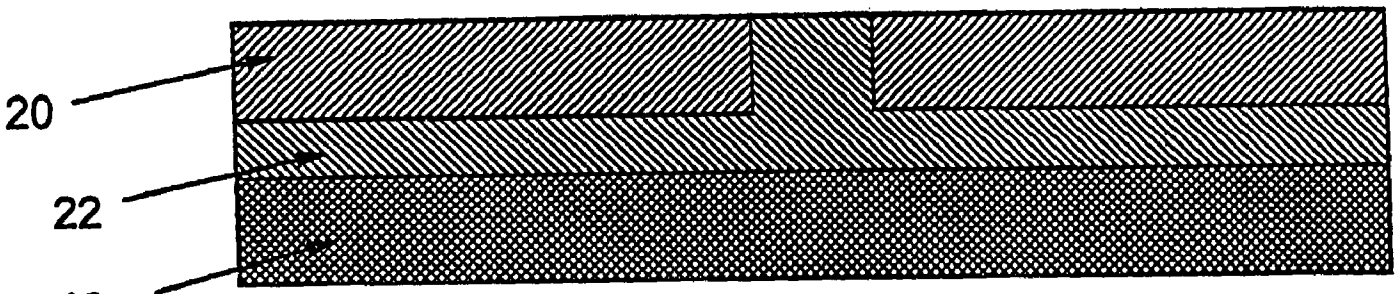
FIGS. 8A-8K show the steps necessary for manufacturing the MEMS switch of the present invention.

FIGS. 8A-8K show the steps necessary for manufacturing the MEMS switches of the present invention. FIG. 8A shows a cross-section of a substrate 18 with metal traces 20 inlaid in surrounding dielectric 22. Substrate 18 is made of any substrate material commonly used for the fabrication of semiconductor devices, such as Si, GaAs, $SiO_2$ or glass. The substrate may also include previously fabricated semiconductor devices, such as transistors, diodes, resistors or capacitors. Interconnect wiring may also be included prior to or during fabrication of the MEMS switch device.

While the following fabrication process is shown for one set of given material layers, it is understood that one skilled in the art may use a different combination of materials to fabricate the same device. The materials used to fabricate this device are classified into three groups. The first group is the metal traces made of known conductive metal elements and alloys of the same elements such as, but not limited to, Al, Cu, Cr, Fe, Hf, Ni, Rh, Ru, Ti, Ta, W and Zr. The metals may also contain N, O, C, Si and H as long as the resulting material is electrically conductive. The second set of materials are the dielectric layers used for the membrane and to insulate the metal conductors and provide physical connection of the movable beam to the substrate such as, but not limited to, carbon-containing materials (including polymers and amorphous hydrogenated carbon), AlN, AlO, HfO, SiN, SiO, SiCH, SiCOH, TaO, TiO, VO, WO and ZrO, or mixtures thereof. The third set of materials layers are the sacrificial layer materials such as but not limited to borophosphosilicate glass (BPSG), Si, SiO, SiN, SiGe, a-C:H, polyimide, polyaralene ethers, norbornenes and their functionalized derivatives, benzocyclobutane and photoresist.

Figure 8B:
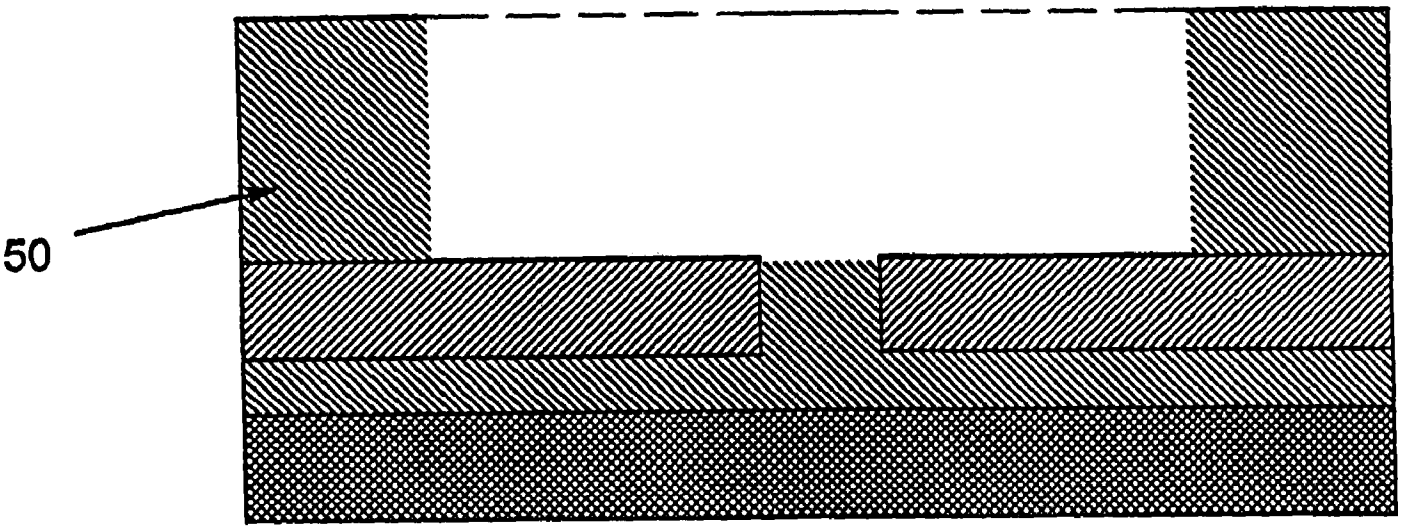
Figure 8C:
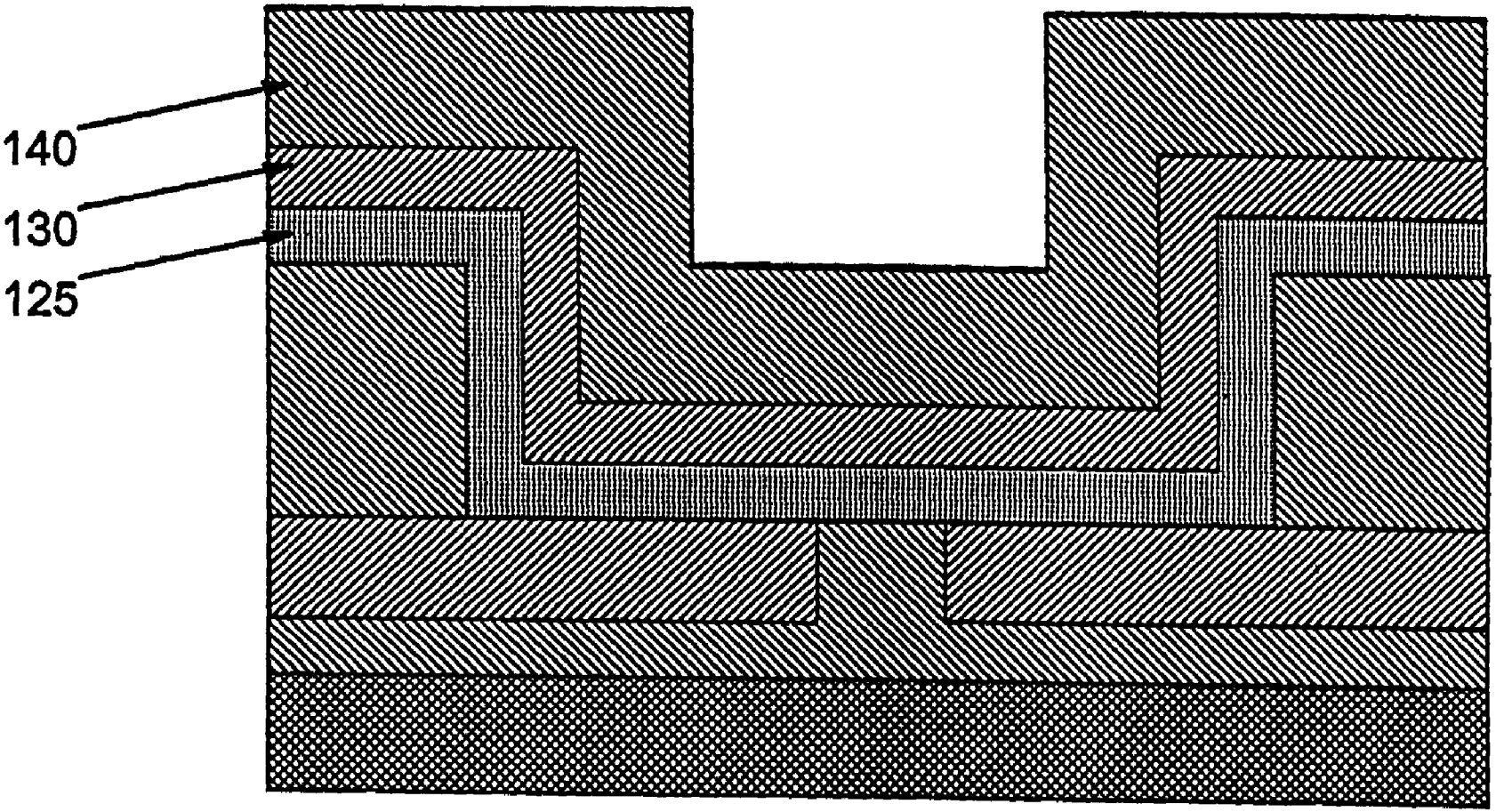
Figure 8D:
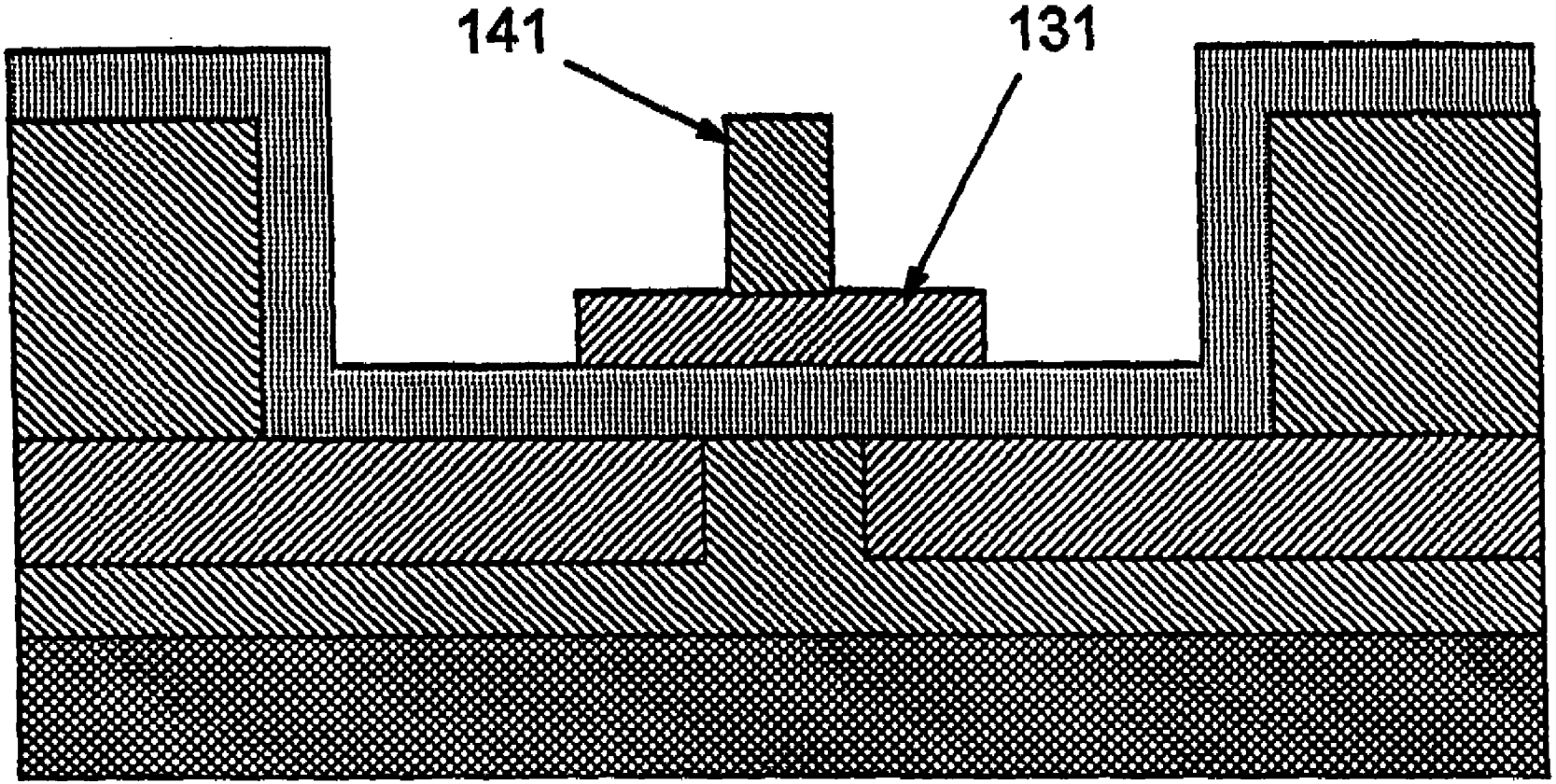
Figure 8E:
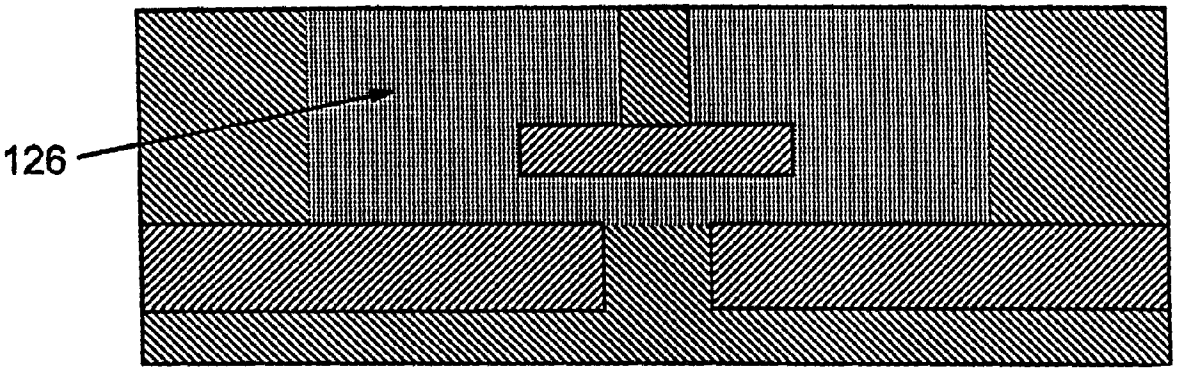
Figure 8F:
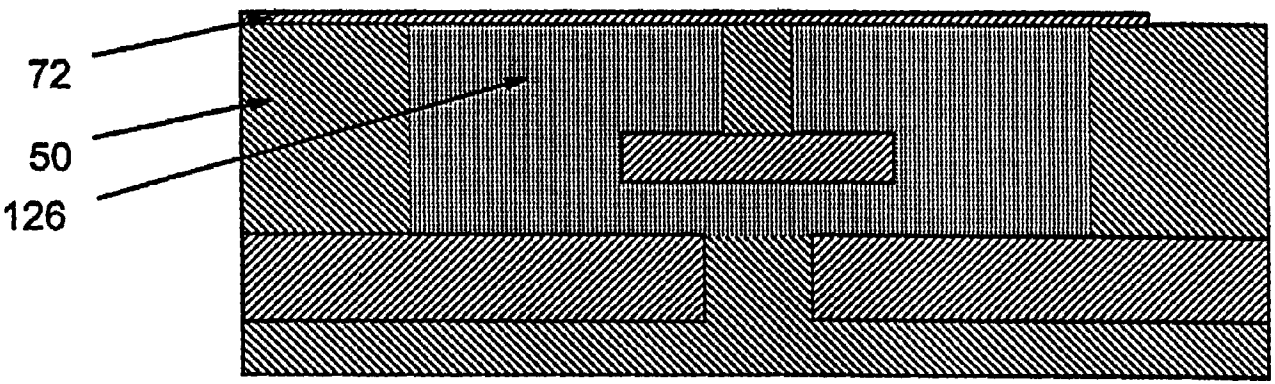

Dielectric 22 may be part of the substrate 18 or the first layers of the MEMS switch. Above this planar surface comprising inlaid metal traces 20 and dielectric 22, another dielectric layer 50 is deposited and patterned as shown in FIG. 8B. An optional etch stop dielectric may be added between dielectric 22 and 50 to minimize etching into dielectric 22 and metal 20. Sacrificial layer 125 is then deposited over patterned dielectric 50, followed by deposition of metal layer 130 and dielectric 140, as shown in FIG. 8C. Lithography followed by etching is used first to pattern dielectric 140, and then again to pattern 130 to form post 141 and bridging contact 131, as shown in FIG. 8D. Layers 130 and 140 may be metal, dielectric or combinations of both, as long as the initial layer 130 is a conductive metal deposited directly on sacrificial layer 125 and electrically conductive enough for good RF signal transmission. Another layer of sacrificial material, 126, is deposited and planarized (FIG. 8E). The surface is planarized by polishing or by a technique such as Chemical Mechanical Polishing (CMP). A thin metal layer 72 is then deposited and patterned over the second planarized surface (FIG. 8F). An etch stop metal or dielectric may be used between the second planarized surface and layer 72 to prevent etching of layers 50 or 126 during the patterning process of layer 72. The next layer to be formed is the micro-mechanical beam or membrane element of the device, 60. Beam or membrane element 60 may be manufactured using any one of the dielectric materials listed above, or combined dielectric layers, for optimal mechanical reliability, performance and manufacturability.

Figure 8G:
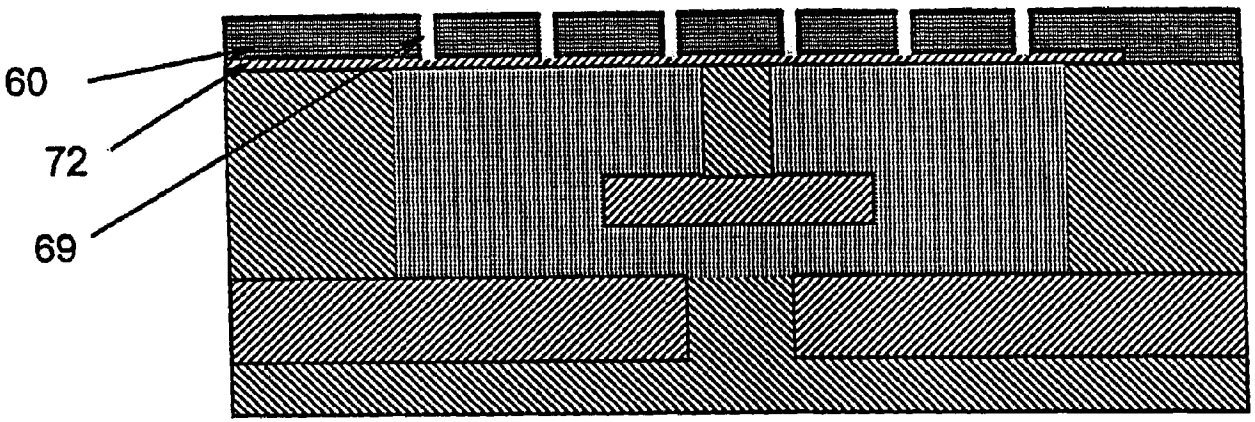
Figure 8H:
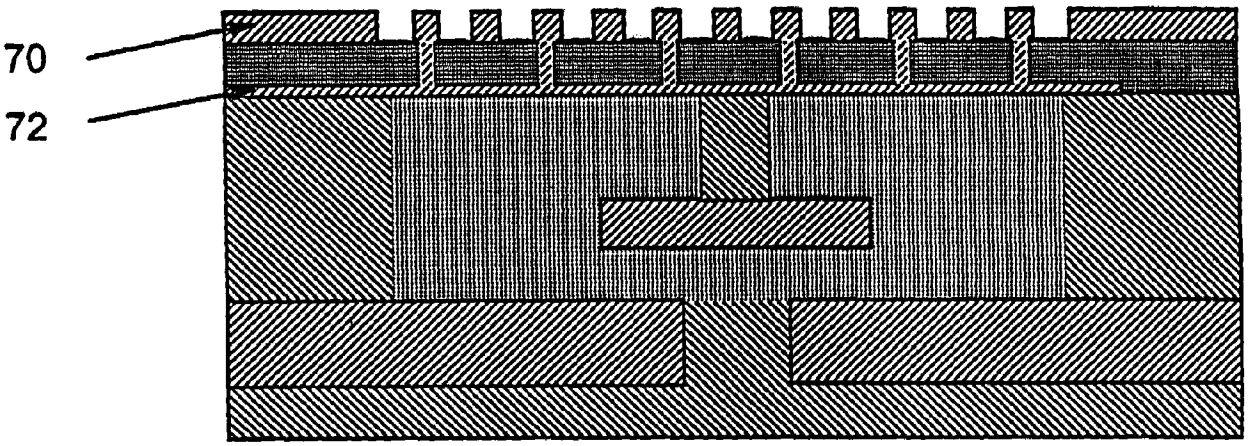
Figure 8I:
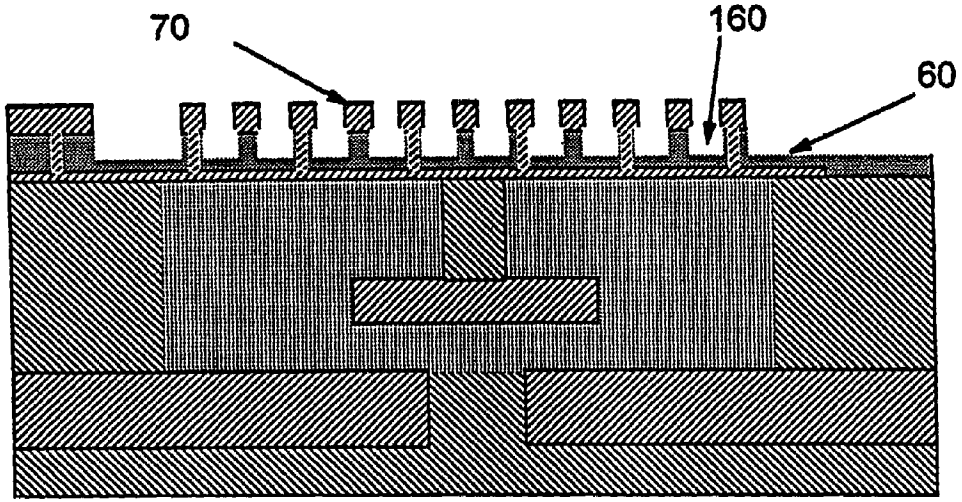
Figure 8J:
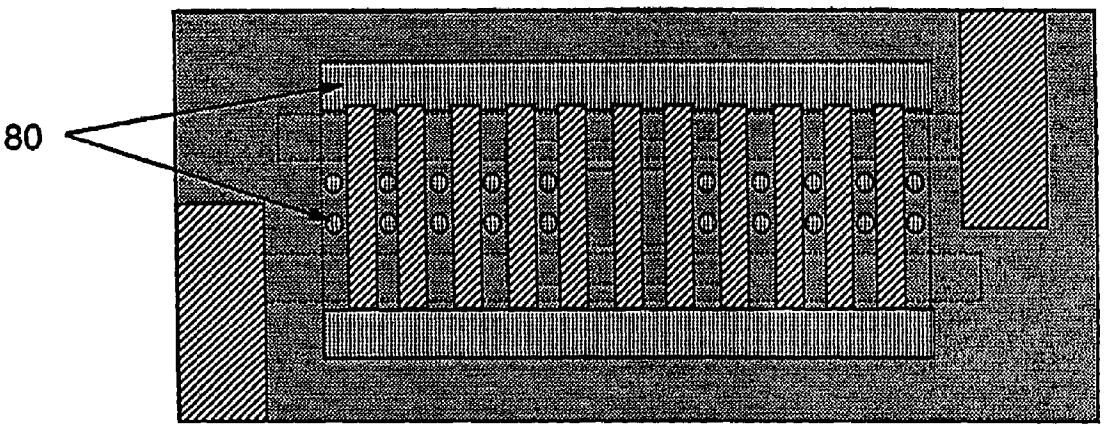
Figure 8K:
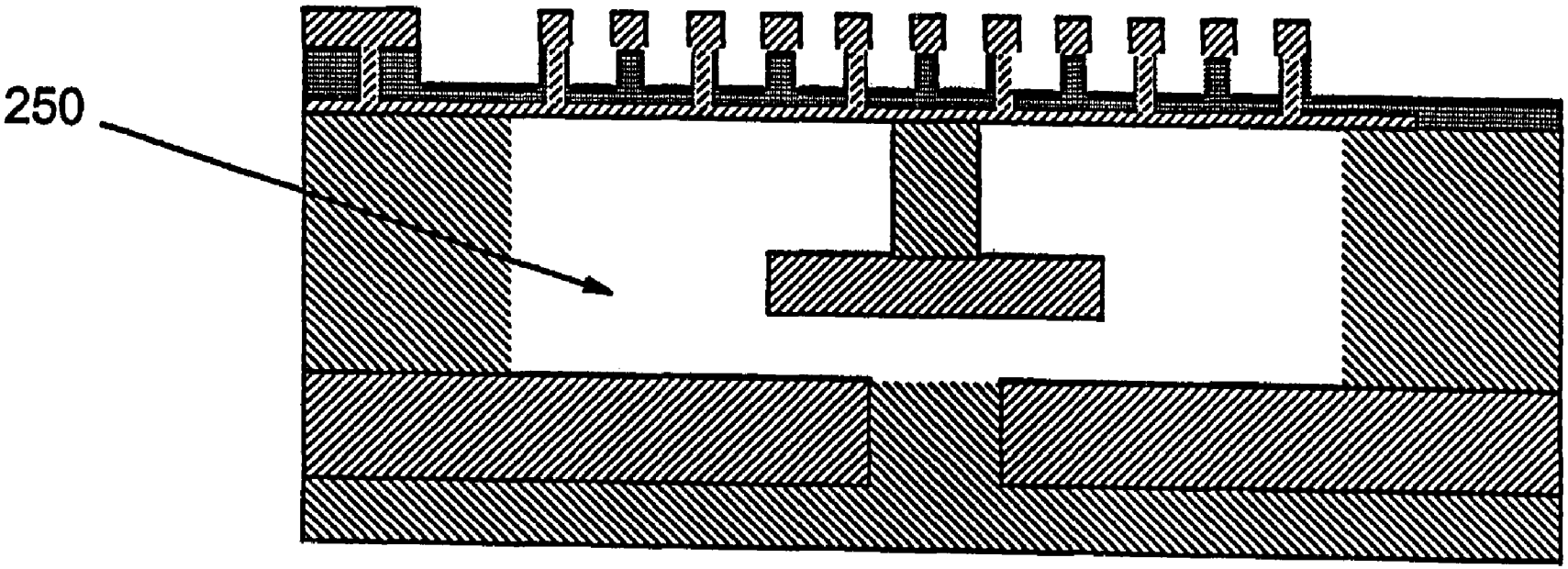

Next, small via holes 69 are formed in dielectric 60, as shown in FIG. 8G, to expose metal layer 72. The number of via holes is kept to a minimum to prevent mechanical weakening of dielectric 60. A metal layer, 70, is then deposited over dielectric 60 which fills via holes 69 for electrical contact between metal layers 72 and 70. Metal layer 70 is then patterned using photolithography and etching. as shown in FIG. 8H. As previously described, the metal actuating fingers 70 are made more effective to induce curvature of membrane 60 if they are anchored onto membrane 60 as levers. Shown in FIG. 8I is the structure with this enhanced feature which is formed by anisotropic etching of dielectric layer 60 using metal 70 as a mask to remove some of the dielectric membrane from region 160. After the anisotropic etch, an optional thin dielectric film is applied over metal fingers 70 and dielectric 60 to prevent DC shorting of metal fingers 70. Using photolithography patterning, access slots and vias 80 are formed in dielectric 60, as shown in the top down view of the device depicted in FIG. 8J. The access pattern is etched completely through dielectric stack 60, exposing sacrificial layer 126. The final step in the MEMS switch fabrication process is the removal of the sacrificial layers 125 and 126 using a selective isotropic etch process which removes the sacrificial material, forming air cavity 250, without substantial etching of exposed dielectric or metal layers as shown in FIG. 8K.

While the presented invention has been described in terms of a preferred embodiment, those skilled in the art will readily recognize that many changes and modifications are possible, all of which remain within the spirit and the scope of the present invention, as defined by the accompanying claims.

INDUSTRIAL APPLICABILITY

This invention is used in the field wireless communications, and more particularly, in cell phones and the like.

What is claimed is:

1. A micro-electromechanical system (MEMS) switch comprising:

a cavity (25);

at least one conductive path (20) integral to a first surface surrounding said cavity;

a flexible membrane (60) parallel to said first surface surrounding said cavity (25), said flexible membrane (60) having a plurality of conductive vias (69) and a plurality of actuating electrodes (70) attached thereto; and a dielectric plunger (40) attached to said flexible membrane (60) in a direction away from said actuating electrodes (70), said dielectric plunger (40) having at least one conductive surface to make electrical contact with said at least one conductive path (20), wherein each of said actuating electrodes (70) is energized by a DC voltage of opposite polarity to the DC voltage of said adjoining actuating electrodes (70).

2. The MEMS switch as recited in claim 1, wherein an electrostatic attraction between said actuating electrodes (70) results in a bending curvature of said flexible membrane (60) when said actuating electrodes (70) are energized.

3. The MEMS switch as recited in claim 1, wherein said flexible membrane (60) is made of a dielectric material selected from the group consisting of SiG, SiN, carbon-containing materials that include polymers and amorphous hydrogenated carbon, and mixtures thereof.

4. The MEMS switch as recited in claim 1, wherein the bending curvature of said flexible membrane urges said at least one conductive surface of said plunger (40) against said at least one conductive surface (20) integral to said first surface surrounding said cavity (25), closing the MEM switch.

5. The MEMS switch as recited in claim 1, wherein the removal of said applied voltage returns said flexible membrane (60) to its original shape, pulling away said at least one conductive surface (30) of said plunger (40) from said at least one conductive surface integral to said first surface surrounding said cavity, opening the MEM switch.

6. The MEMS switch as recited in claim 1, wherein the bending curvature of said flexible membrane (60) is a concave displacement.

7. The MEMS switch as recited in claim 1, further comprising a second plurality of electrodes (74) placed on a bottom surface of the flexible membrane (60), wherein a reverse positive and negative voltage applied to said second plurality of electrodes (70) urges said plunger (40) away from said at least one conductive path (20), overcoming stiction.

8. The MEMS switch as recited in claim 1, wherein a piezoelectric material integral to said flexible membrane (60) and positioned between said actuating electrodes (70) expands and contracts said flexible membrane (60) when subjected to a DC voltage.

9. The MEMS switch as recited in claim 8, wherein depending on said piezoelectric material and its crystalline orientation, applying a voltage difference between said actuating electrodes (70) forces said flexible membrane (60) to adopt a concave or convex curvature.

10. The MEMS switch as recited in claim 8, wherein said piezoelectric material is selected from the group consisting of $BaTiO_3$, $Pb(ZrxTil\text{-}x)O_3$ with dopants of La, Fe or Sr, and polyvinylidene fluoride (PVDF).

11. The MEMS switch as recited in claim 1, wherein an RF gap area located within said cavity (25) is physically separated from gaps between said actuating electrodes.

12. The MEMS switch as recited in claim 1, wherein the flexible membrane (60) is electrostatically displaced in two opposing directions, thereby aiding to activate and deactivate the MEMS switch (15).

13. A micro-electromechanical system (MEMS) switch comprising:

a) a substrate (18) comprising a conductive metal inlaid surface (20) onto which a cavity (250) is formed;

b) on said cavity (250), a first release layer (125) followed by a first conductive layer (130) and by a second conductive or dielectric layer (140), said two conductive layers (130, 140) being patterned into the form of an inverted C T C (131, 141);

c) a planarized second release layer (72) followed by a third conductive layer (60);

d) on top of said third conductive layer (60), a dielectric layer and patterned vias holes (160) to expose a lower conductor;

e) a conductive surface filling said patterned via holes (160) providing a finite thickness above said filled via holes (160), said conductive surface patterned into the shape of actuating fingers (70), said combination of a) through e) forming a flexible membrane; and f) via holes perforating said flexible membrane and simultaneously providing access slots (80) outside of said membrane, wherein air replaces said first and second release layers (125, 72).

14. The MEMS switch as recited in claim 13, wherein said conductive layers include metal traces made of conductive metal elements selected from the group consisting of Al, Cu, Cr, Fe, Hf, Ni, Rh, Ru, Ti, Ta, W, Zr and alloys thereof.

15. The MEMS switch as recited in claim 14, wherein said metal traces include elements selected from the group consisting of N, O, C, Si and H, as long as said metal traces are electrically conductive.

16. The MEMS switch as recited in claim 13, wherein said flexible membrane and said dielectric layers are made of a material selected from the group consisting of AlN, AlO, HfO, SiN, SiG, SiCH, SiCOH, TaO, TiG, VO, WO, ZrO, and mixtures thereof.

17. The MEMS switch as recited in claim 13, wherein said release layer is a sacrificial layer which is made of a material selected from the group consisting of borophosphosilicate glass (BPSG), Si, SiO, SiN, SiGe, a-C:H, polyimide, polyaralene ethers, norbomenes, and their functionalized derivatives, including benzocyclobutane and photoresist.

* * * * *